US012312648B2

(12) United States Patent
Kong et al.

(10) Patent No.: US 12,312,648 B2
(45) Date of Patent: May 27, 2025

(54) HOT-ROLLED STEEL SHEET WITH EXCELLENT LOW-TEMPERATURE IMPACT TOUGHNESS AND MANUFACTURING METHOD THEREFOR

(71) Applicant: POSCO, Pohang-si Gyeongsangbuk-do (KR)

(72) Inventors: Jung Hyun Kong, Pohang-si Gyeongsangbuk-do (KR); Mun-Soo Lee, Pohang-si Gyeongsangbuk-do (KR)

(73) Assignee: POSCO CO., LTD, Pohang-si (KR)

( * ) Notice: Subject to any disclaimer, the term of this patent is extended or adjusted under 35 U.S.C. 154(b) by 920 days.

(21) Appl. No.: 17/291,361

(22) PCT Filed: Oct. 31, 2019

(86) PCT No.: PCT/KR2019/014541
§ 371 (c)(1),
(2) Date: May 5, 2021

(87) PCT Pub. No.: WO2020/096268
PCT Pub. Date: May 14, 2020

(65) Prior Publication Data
US 2022/0002828 A1 Jan. 6, 2022

(30) Foreign Application Priority Data
Nov. 6, 2018 (KR) ..... 10-2018-0135153

(51) Int. Cl.
*C22C 38/00* (2006.01)
*B21B 1/16* (2006.01)
(Continued)

(52) U.S. Cl.
CPC ..... *C21D 9/46* (2013.01); *B21B 1/16* (2013.01); *C21D 6/004* (2013.01); *C21D 6/005* (2013.01);
(Continued)

(58) Field of Classification Search
CPC ..... C21D 9/46; C21D 6/004; C21D 6/005; C21D 6/008; C21D 8/0205; C21D 8/0226;
(Continued)

(56) References Cited

U.S. PATENT DOCUMENTS 9,493,865 B2 * 11/2016 Kami ..... C22C 38/08
2004/0065390 A1 4/2004 Oku et al.
(Continued)

FOREIGN PATENT DOCUMENTS

CN 1363710 A 8/2002
CN 106133166 A 11/2016
(Continued)

OTHER PUBLICATIONS

KR-20130048980-A, machine translation. (Year: 2013).*
(Continued)

*Primary Examiner* — John A Hevey
(74) *Attorney, Agent, or Firm* — Morgan Lewis & Bockius LLP

(57) ABSTRACT

Disclosed are a hot-rolled steel sheet having a thickness of 6 mm or more and an excellent impact property, and a manufacturing method thereof.
In accordance with an aspect of the present disclosure, a hot-rolled steel sheet with excellent low-temperature impact toughness includes, in percent (%) by weight of the entire composition, C: more than 0 and 0.03% or less, Si: 0.1 to 1.0%, Mn: more than 0 and 2.0% or less, P: 0.04% or less, Cr: 1.0 to 10%, Ni: more than 0 and 1.5% or less, Ti: 0.01
(Continued)

to 0.5%, Cu: more than 0 and 2.0% or less, N: more than 0 and 0.03% or less, Al: 0.1% or less, the remainder of iron (Fe) and other inevitable impurities, a value of the following Formula (1) satisfies 200 to 1,150, and a microstructure of the cross-section perpendicular to the rolling direction has an average grain size of 50 μm or less in which a misorientation between grains is 5° or more.

$$1001.5*C+1150.6*Mn+2000*Ni+395.6*Cu-0.7*Si-1.0*Ti-45*Cr-1.0*P-1.0*Al+1020.5*N \quad (1)$$

6 Claims, 11 Drawing Sheets

(51) Int. Cl.

| | |
|---|---|
| ***C21D 6/00*** | (2006.01) |
| ***C21D 8/02*** | (2006.01) |
| ***C21D 9/46*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/50*** | (2006.01) |

(52) U.S. Cl.
CPC ..... *C21D 6/008* (2013.01); *C21D 8/0205* (2013.01); *C21D 8/0226* (2013.01); *C21D 8/0263* (2013.01); *C22C 38/001* (2013.01); *C22C 38/002* (2013.01); *C22C 38/02* (2013.01); *C22C 38/04* (2013.01); *C22C 38/06* (2013.01); *C22C 38/42* (2013.01); *C22C 38/50* (2013.01); *C21D 2211/005* (2013.01); *C21D 2211/008* (2013.01)

(58) Field of Classification Search
CPC ..... C21D 8/0263; C21D 2211/005; C21D 2211/008; C21D 6/00; C21D 8/02; C21D 2201/05; B21B 1/16; B21B 3/00; C22C 38/001; C22C 38/002; C22C 38/02; C22C 38/04; C22C 38/06; C22C 38/42; C22C 38/50; C22C 38/004; C22C 38/58
See application file for complete search history.

(56) References Cited

U.S. PATENT DOCUMENTS

| | | | | |
|---|---|---|---|---|
| 2013/0126052 | A1 | 5/2013 | Ota et al. | |
| 2013/0306204 | A1 | 11/2013 | Teraoka et al. | |
| 2017/0107593 | A1* | 4/2017 | Hamada | C21D 8/0263 |
| 2022/0042151 | A1* | 2/2022 | Kong | C21D 8/0205 |

FOREIGN PATENT DOCUMENTS

| | | | | | |
|---|---|---|---|---|---|
| CN | 106435360 | A | | 2/2017 | |
| JP | 2000144258 | A | | 5/2000 | |
| JP | 4239257 | B2 | | 3/2009 | |
| JP | 2009068034 | A | | 4/2009 | |
| JP | 2014-189862 | A | | 10/2014 | |
| JP | 2016191150 | A | | 11/2016 | |
| KR | 20130048980 | A | * | 5/2013 | C22C 38/50 |
| KR | 10-2016-0123371 | A | | 10/2016 | |
| KR | 10-2017-0070939 | A | | 6/2017 | |
| WO | 2017/169011 | A1 | | 10/2017 | |
| WO | 2018/158853 | A1 | | 9/2018 | |

OTHER PUBLICATIONS

Chinese Office Action dated May 18, 2022 issued in Chinese Patent Application No. 201980080745.4 (with English translation).
Office Action issued in Korean Patent Application 10-2018-0135153 dated Apr. 13, 2020.
Notice of Allowance issued in Korean Patent Application 10-2018-0135153 dated Sep. 3, 2020.
International Search Report issued in Application No. PCT/KR2019/014541 dated Mar. 2, 2020.
Extended European Search Report dated Nov. 22, 2021 issued in European Patent Application No. 19882479.9.

* cited by examiner

【FIG. 1】
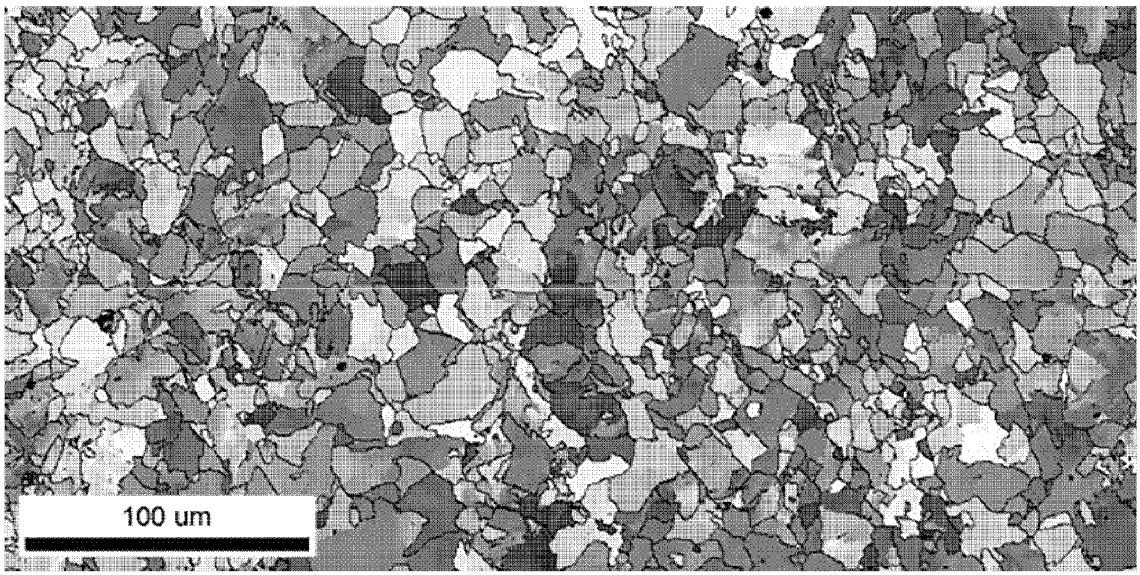

【FIG. 2】
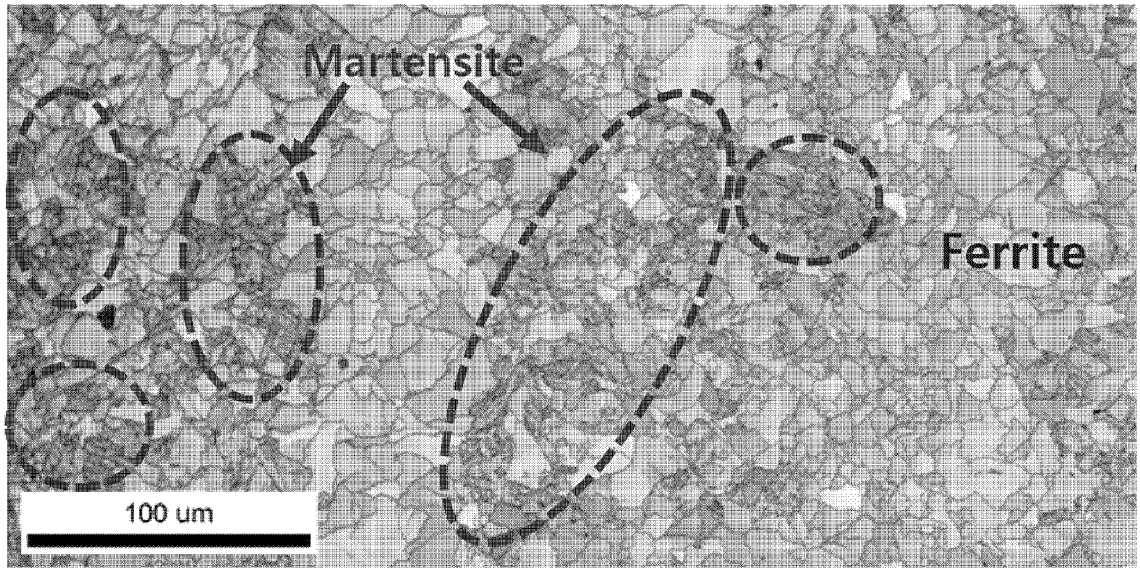

【FIG. 3】
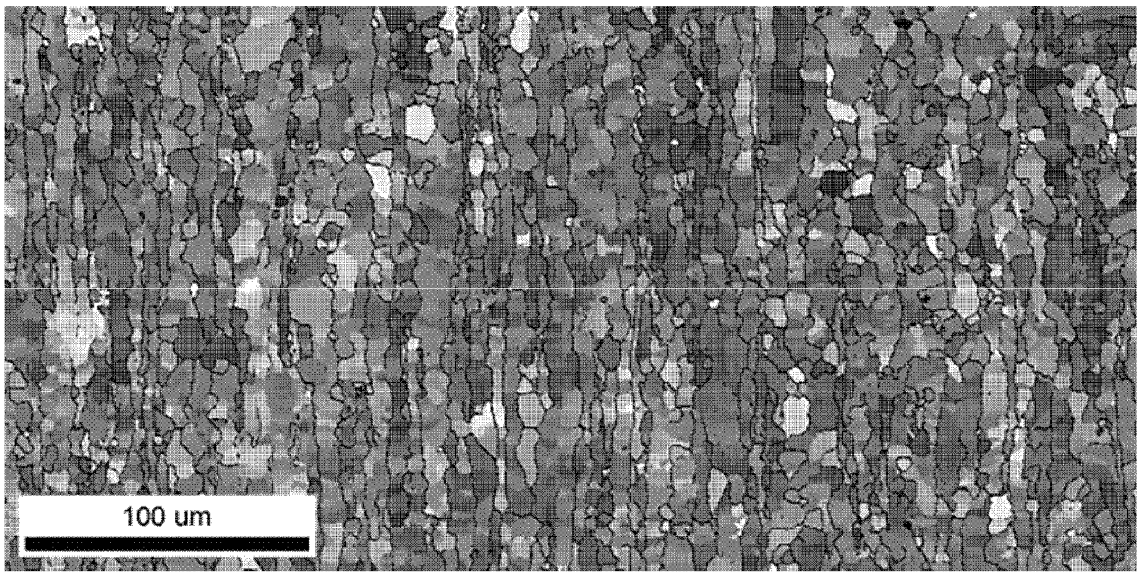

【FIG. 4】
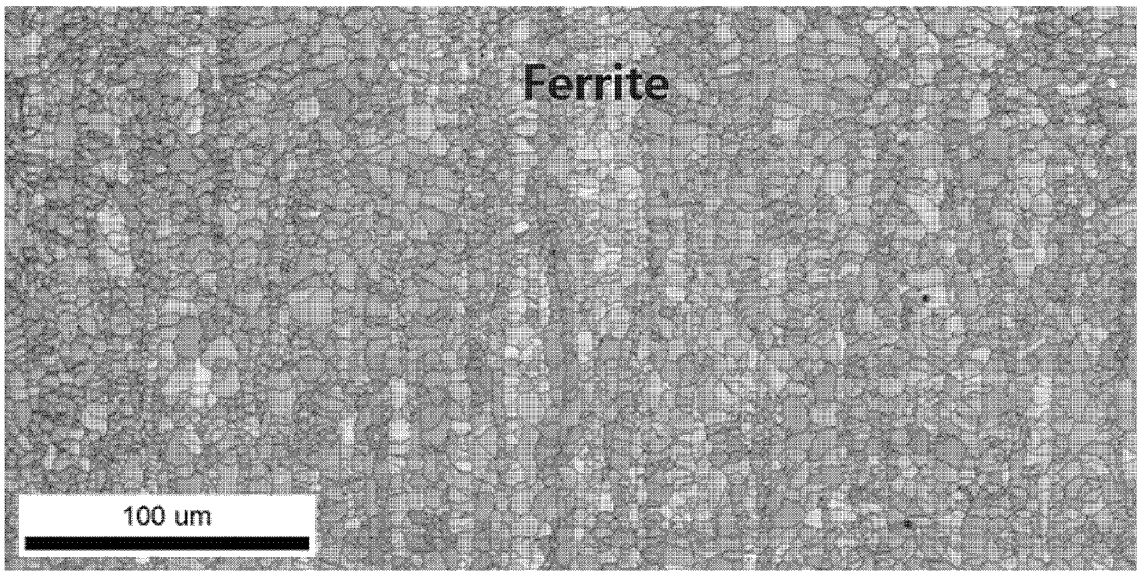

【FIG. 5】
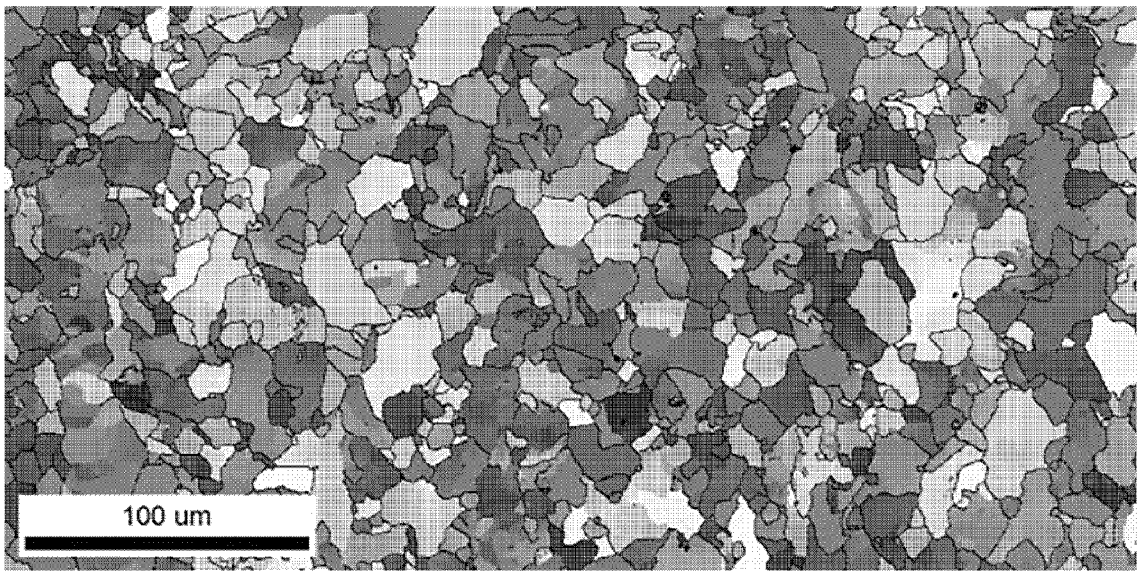

【FIG. 6】
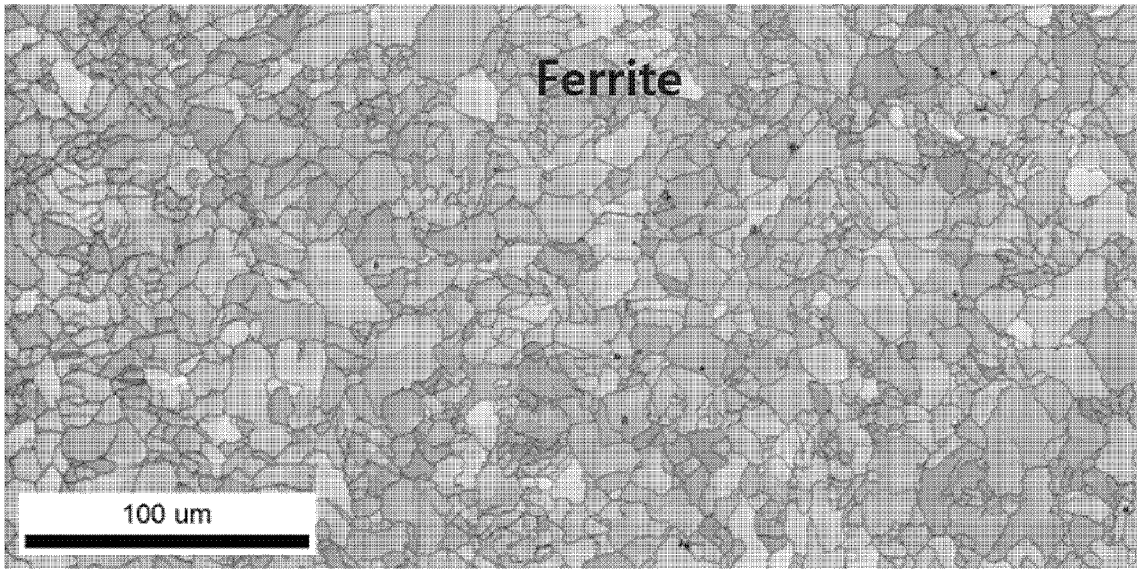

【FIG. 7】
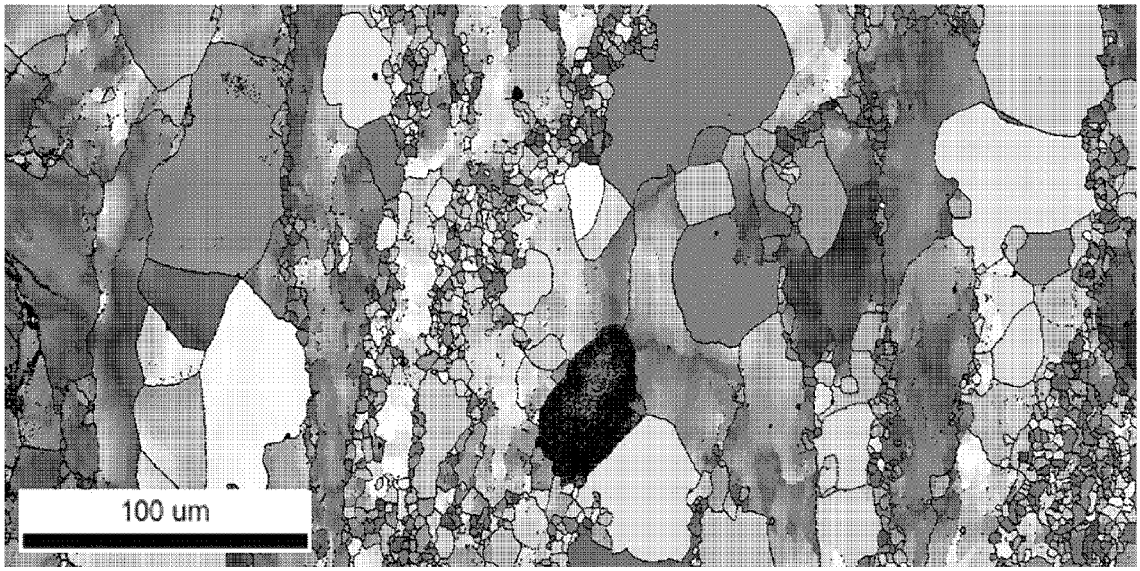

【FIG. 8】
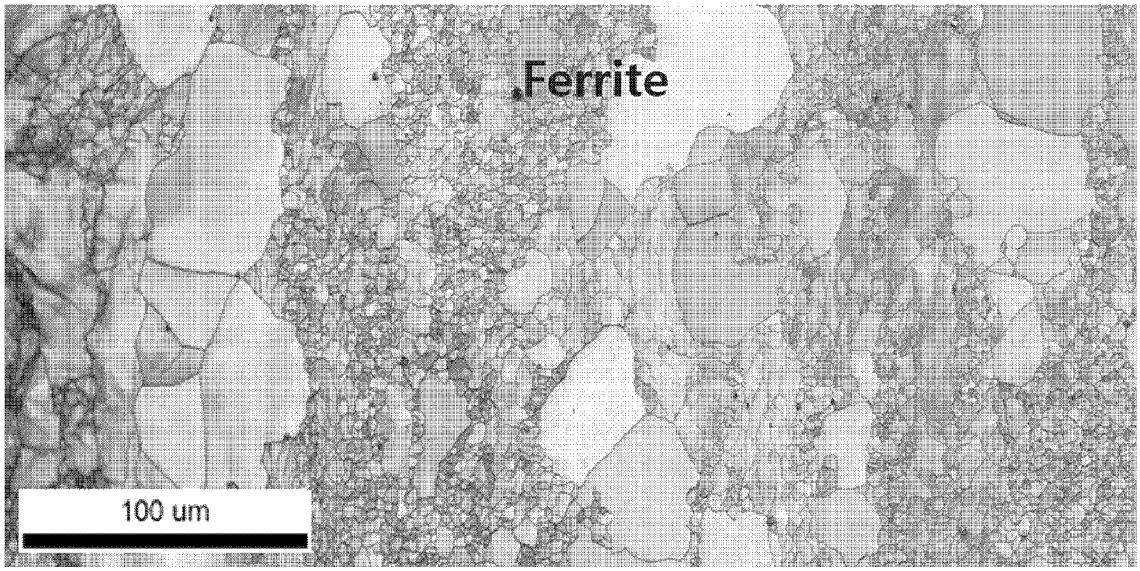

【FIG. 9】
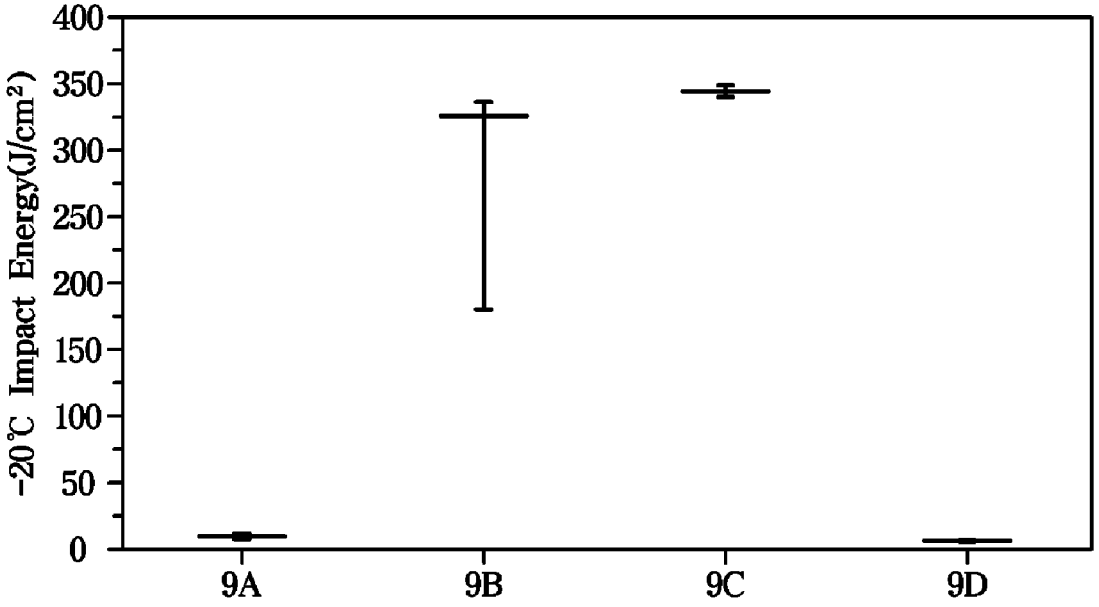

【FIG. 10】
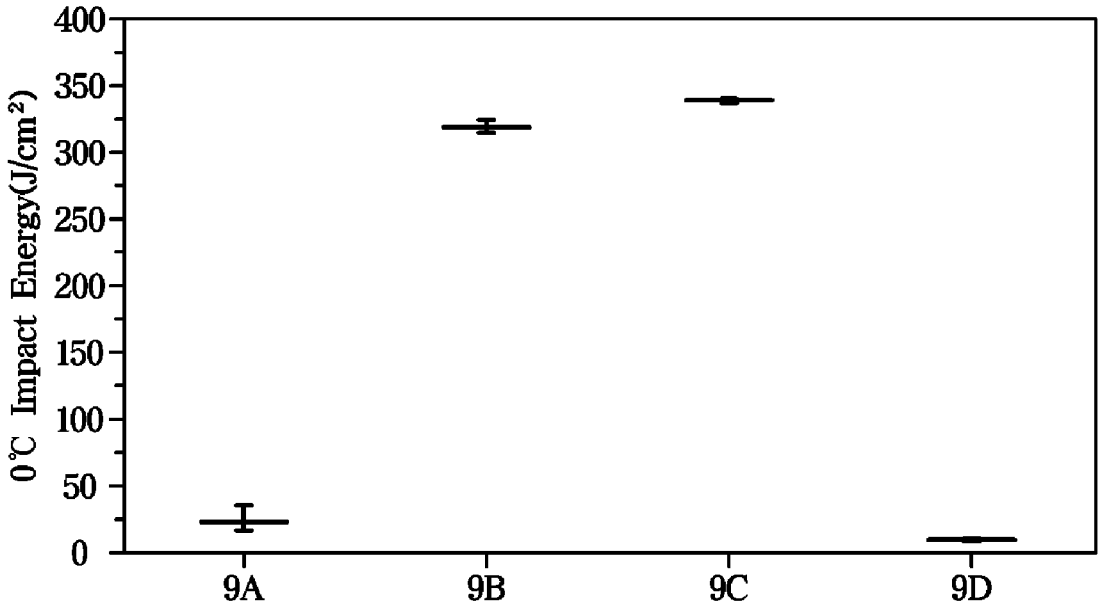

【FIG. 11】
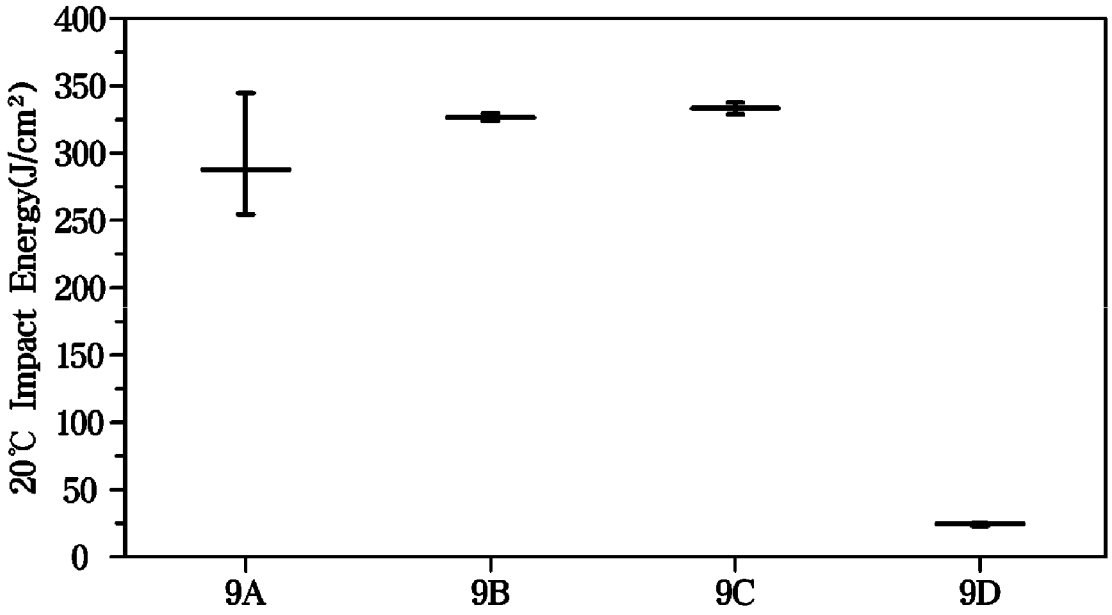

HOT-ROLLED STEEL SHEET WITH EXCELLENT LOW-TEMPERATURE IMPACT TOUGHNESS AND MANUFACTURING METHOD THEREFOR

CROSS-REFERENCE OF RELATED APPLICATIONS

This application is the U.S. National Phase under 35 U.S.C. § 371 of International Patent Application No. PCT/KR2019/014541, filed on Oct. 31, 2019, which claims the benefit of Korean Patent Application No. 10-2018-0135153, filed on Nov. 6, 2018, the entire disclosures of each are incorporated by reference herein.

TECHNICAL FIELD

The present disclosure relates to a hot-rolled thick material and a manufacturing method thereof, and more particularly, to a hot-rolled steel sheet having a thickness of 6 mm or more and excellent in impact characteristics, and a manufacturing method thereof.

BACKGROUND ART

The exhaust gas path of automobiles is made up of a variety of parts, and fastening parts called flanges are often used to connect these parts. In automobile exhaust system parts, the number of processing steps can be reduced and the working space can be narrowed, so flange joints are actively used. In addition, from the viewpoint of reducing noise and securing rigidity, due to vibration, a thick flange with a thickness of 6 mm or more is often used.

Ferritic stainless steel has inferior workability, impact toughness and high temperature strength compared to austenitic stainless steel, but since it does not contain a large amount of Ni, it is inexpensive and has low thermal expansion. In recent years, it is preferred to use it for automobile exhaust system component materials. In particular, flanges for exhaust systems have recently been converted into ferritic stainless thick plates with improved corrosion resistance and durability due to micro-cracks and exhaust gas leakage problems.

Flanges are conventionally manufactured using carbon steel, but since carbon steel has low corrosion resistance, which causes severe red rust on the outer surface due to rapid corrosion, ferritic stainless steel is mainly used in recent years. STS409L material is a steel grade with excellent workability and prevention of sensitization of welds by stabilizing C, N in 11% Cr with Ti, and is mainly used at temperatures at 700° C. or less. STS409L material is the most widely used steel grade because it has some corrosion resistance even against the condensate component generated in the exhaust system of automobiles.

However, ferritic stainless steel also has a chronic problem of poor impact toughness. If the toughness is low, the plate breaks due to brittle crack propagation during the manufacturing process of the steel plate, or cracks occur due to the impact applied during flange processing. In addition, thick materials with a thickness of 6.0 mm or more have a problem in that it is difficult to obtain fine grains due to lack of rolling reduction during hot rolling, and the brittleness is further deepened due to the formation of coarse grains and non-uniform grains, resulting in poor impact characteristics.

As such, carbon steel for flanges has a problem of poor corrosion resistance, and ferritic stainless steel has a problem of poor impact characteristics. It is difficult to find a satisfactory flange material that can solve this at the same time.

DISCLOSURE

Technical Problem

The embodiments of the present disclosure solve the above problems, and intend to provide a hot-rolled steel sheet with improved corrosion resistance and low-temperature impact toughness by securing fine ferrite grains through alloy composition control by adding Cr of 10.5% or less, Ni, Mn, and Cu

Technical Solution

In accordance with an aspect of the present disclosure, a hot-rolled steel sheet with excellent low-temperature impact toughness includes, in percent (%) by weight of the entire composition, C: more than 0 and 0.03% or less, Si: 0.1 to 1.0%, Mn: more than 0 and 2.0% or less, P: 0.04% or less, Cr: 1.0 to 10%, Ni: more than 0 and 1.5% or less, Ti: 0.01 to 0.5%, Cu: more than 0 and 2.0% or less, N: more than 0 and 0.03% or less, Al: 0.1% or less, the remainder of iron (Fe) and other inevitable impurities, a value of the following Formula (1) satisfies 200 to 1,150, and a microstructure of the cross-section perpendicular to the rolling direction has an average grain size of 50 μm or less in which a misorientation between grains is 5° or more.

$$1001.5*C+1150.6*Mn+2000*Ni+395.6*Cu-0.7*Si-1.0*Ti-45*Cr-1.0*P-1.0*Al+1020.5*N \quad (1)$$

Here, C, Mn, Ni, Cu, Si, Ti, Cr, P, Al and N mean the content (% by weight) of each element.

In addition, the hot-rolled steel sheet may have a thickness of 6.0 to 25.0 mm and −20° C. Charpy impact energy of 100 J/cm$^2$ or more.

In addition, the value of Formula (1) may satisfy 200 to 700.

In addition, the hot-rolled steel sheet may satisfy the following Formula (2).

$$Ti/(C+N) \geq 10.0 \quad (2)$$

In addition, the microstructure may have an average grain size of 70 μm or less in which a misorientation between grains is 15 to 180°.

In addition, the microstructure may have an average grain size of 50 μm or less in which a misorientation between grains is 5 to 180°.

In addition, the microstructure may have an average grain size of 30 μm or less in which a misorientation between grains is 2 to 180°

In accordance with another aspect of the present disclosure, a manufacturing method of a hot-rolled steel sheet with excellent low-temperature impact toughness includes: heating the slab containing in percent (%) by weight of the entire composition, C: more than 0 and 0.03% or less, Si: 0.1 to 1.0%, Mn: more than 0 and 2.0% or less, P: 0.04% or less, Cr: 1.0 to 10%, Ni: more than 0 and 1.5% or less, Ti: 0.01 to 0.5%, Cu: more than 0 and 2.0% or less, N: more than 0 and 0.03% or less, Al: 0.1% or less, the remainder of iron (Fe) and other inevitable impurities, at 1,220° C. or less; rough rolling the heated slab; finishing rolling the rough rolled bar; and winding a hot-rolled steel sheet, and the reduction ratio in the last rolling mill of the rough rolling is 27% or more, a coiling temperature is 850° C. or less.

In addition, the slab may satisfy a value of a following Formula (1) of a range of 200 to 1,150.

$$1001.5*C+1150.6*Mn+2000*Ni+395.6*Cu-0.7*Si-1.0*Ti-45*Cr-1.0*P-1.0*Al+1020.5*N \quad (1)$$

Here, C, Mn, Ni, Cu, Si, Ti, Cr, P, Al and N mean the content (% by weight) of each element.

In addition, the slab may satisfy a value of the Formula (1) of a range of 200 to 700.

In addition, the temperature of the rough rolled bar may be 1,020 to 970° C.

In addition, the finishing rolling end temperature may be 920° C. or less.

In addition, the thickness of the hot-rolled steel sheet may be 6.0 to 25.0 mm.

In addition, the microstructure of the cross-section perpendicular to the rolling direction of the wound hot-rolled steel sheet may have an average grain size of 50 μm or less in which a misorientation between grains is 5° or more.

In addition, the manufacturing method may further include: annealing the wound hot-rolled steel sheet, and a temperature range of the annealing may be 850° C. or less.

Advantageous Effects

According to an embodiment of the present disclosure, a high Charpy impact energy value may be exhibited by minimizing the microstructure grain size of a hot-rolled steel sheet having a thickness of 6.0 mm or more containing Cr of 10.0% or less.

DESCRIPTION OF DRAWINGS

FIGS. 1 and 2 are cross-sectional microstructure IPF(ND) EBSD photographs and IQ EBSD photographs of the 9A steel.

FIGS. 3 and 4 are cross-sectional microstructure IPF(ND) EBSD photographs and IQ EBSD photographs of the 9B steel.

FIGS. 5 and 6 are cross-sectional microstructure IPF(ND) EBSD photographs and IQ EBSD photographs of 9C steel.

FIGS. 7 and 8 are cross-sectional microstructure IPF(ND) EBSD photographs and IQ EBSD photographs of 9D steel.

FIGS. 9 to 11 are graphs showing Charpy impact energy values at −20, 0° C., and +20° C. of Inventive Examples and Comparative Examples according to an embodiment of the present disclosure.

BEST MODE

A hot-rolled steel sheet with excellent low-temperature impact toughness according to an embodiment of present disclosure includes, in percent (%) by weight of the entire composition, C: more than 0 and 0.03% or less, Si: 0.1 to 1.0%, Mn: more than 0 and 2.0% or less, P: 0.04% or less, Cr: 1.0 to 10%, Ni: more than 0 and 1.5% or less, Ti: 0.01 to 0.5%, Cu: more than 0 and 2.0% or less, N: more than 0 and 0.03% or less, Al: 0.1% or less, the remainder of iron (Fe) and other inevitable impurities, a value of the following Formula (1) satisfies 200 to 1,150, and an average size of grains with a misorientation between grains of 5° or more of the microstructure of the cross-section perpendicular to the rolling direction is 50 μm or less.

$$1001.5*C+1150.6*Mn+2000*Ni+395.6*Cu-0.7*Si-1.0*Ti-45*Cr-1.0*P-1.0*Al+1020.5*N \quad (1)$$

Here, C, Mn, Ni, Cu, Si, Ti, Cr, P, Al and N mean the content (% by weight) of each element.

MODES OF THE INVENTION

Hereinafter, the embodiments of the present disclosure will be described in detail with reference to the accompanying drawings. The following embodiments are provided to transfer the technical concepts of the present disclosure to one of ordinary skill in the art. However, the present disclosure is not limited to these embodiments, and may be embodied in another form. In the drawings, parts that are irrelevant to the descriptions may be not shown in order to clarify the present disclosure, and also, for easy understanding, the sizes of components are more or less exaggeratedly shown.

Various methods have been studied for improving the toughness of ferritic hot rolled thick plates. First, there is a method of suppressing the Laves Phase, which deteriorates the brittleness of a material by lowering the hot-rolled coiling temperature or by performing a rapid cooling treatment such as water cooling. However, this causes bad coils such as scratch marks on the surface of the plate due to low temperature when coiling, or has a problem in that the deformation of the plate becomes non-uniform due to the rapid cooling rate, and partially cracks are generated. Therefore, this method has difficulties in practical production applications. Also, when hot rolling of hot rolled steel sheet having a thickness of 6.0 mm or more, it is difficult to obtain a fine grain size due to insufficient rolling reduction compared to a steel plate with a thickness of 6.0 mm or less, and a problem of increasing brittleness due to formation of coarse grains and non-uniform grains has also been raised. In addition, as the content of Cr, which is a ferrite stabilizing element, increases to 11% or more, the brittleness becomes more severe and is not preferable in terms of economy.

In the present disclosure, by limiting the Cr content of the hot-rolled thick plate with a thickness of 6.0 mm or more to 10.0% or less, and by adding Ni, Mn or Cu, the austenite phase transformation and recrystallization are induced during hot rolling by controlling the austenite phase fraction rather than the ferrite single phase at a hot-rolled reheating temperature of 1,220° C. or less to a certain amount or more, thereby securing the final fine ferrite grains during winding. The hot-rolled steel sheet according to the present disclosure, after the hot rolling is completed, can control the average grain size of the microstructure of the cross-section perpendicular to the rolling direction to be 30 μm or less.

In the present specification, 'hot-rolled steel sheet' means a ferritic hot-rolled steel sheet having a thickness of 6.0 mm or more.

A hot-rolled steel sheet with excellent low-temperature impact toughness according to present disclosure includes, in percent (%) by weight of the entire composition, C: more than 0 and 0.03% or less, Si: 0.1 to 1.0%, Mn: more than 0 and 2.0% or less, P: 0.04% or less, Cr: 1.0 to 10%, Ni: more than 0 and 1.5% or less, Ti: 0.01 to 0.5%, Cu: more than 0 and 2.0% or less, N: more than 0 and 0.03% or less, Al: 0.1% or less, the remainder of iron (Fe) and other inevitable impurities.

Hereinafter, the reason for the numerical limitation of the alloy component element content in the embodiment of the present disclosure will be described. In the following, unless otherwise specified, the unit is % by weight.

The content of C and N is more than 0 and 0.03% or less, respectively.

In the case of C and N being present in an interstitial form as Ti(C, N) carbonitride-forming elements, Ti(C, N) carbonitride is not formed when C and N contents are high, and C and N present at a high concentration deteriorate elongation and low-temperature impact properties of the material. When the material is used at 600° C. or below for a long period of time after welding, intergranular corrosion occurs due to generation of $Cr_{23}C_6$ carbide, and therefore the content of C and N is preferably controlled to be 0.03% or less, respectively.

The content of Si is 0.1 to 1.0%.

Si is a deoxidizing element and is added at least 0.1% for deoxidation, and since it is an element forming a ferrite phase, the stability of the ferrite phase increases when the content increases. If the content of Si is more than 1.0%, steelmaking Si inclusions are increased and surface defects occur. For this reason, the Si content is preferably controlled to be 1.0% or less.

The content of Mn is more than 0 and 2.0% or less.

Mn is an austenite phase stabilizing element, and is added to secure a certain level of austenite phase fraction at hot rolling reheating temperature. However, when the content is increased, since precipitates such as MnS are formed to reduce pitting resistance, it is preferable to control the content of Mn to 2.0% or less.

The content of P is 0.04% or less.

Since P is included as an impurity in ferrochrome, a raw material for stainless steel, it is determined by the purity and quantity of ferrochrome. However, since P is a harmful element, it is preferable to have a low content, but since low-P ferrochrome is expensive, it is set to 0.04% or less, which is a range that does not significantly deteriorate the material or corrosion resistance. More preferably, it may be limited to 0.03% or less.

The content of Cr is 1.0 to 10.0%.

Cr is added at least 1.0% to ensure the corrosion resistance of the steel sheet. When the content of Cr is low, the corrosion resistance in a condensed water atmosphere decreases, and when the content is increased, the strength increases and the elongation and impact toughness decrease. In particular, in the case of ferritic stainless steel containing 11.0% or more, brittleness is more severe. In the present disclosure, the content is limited to 10.0% or less in order to secure low-temperature impact toughness.

The content of Ni is more than 0 and 1.5% or less.

Ni is an austenite phase stabilizing element, and is effective in suppressing the growth of pitting, and is effective in improving the toughness of hot-rolled steel sheets when added in small amounts. It is added to secure a certain level of austenite phase fraction at the hot-rolled reheating temperature related to Formula (1), which will be described later. However, a large amount of addition may cause material hardening and toughness reduction due to solid solution strengthening, and since it is an expensive element, it may be limited to 1.5% or less in consideration of the content relationship between Mn and Cu.

The content of Ti is 0.01 to 0.5%.

Ti is an effective element that fixes C and N to prevent intergranular corrosion. However, when the content of Ti is decreased, due to intergranular corrosion occurring at welded areas, corrosion resistance is decreased, and therefore Ti is preferably controlled to be at least 0.01% or more. In order to sufficiently fix C and N, it is desirable to control it to 10*(C+N) or more. However, when the Ti content is too high, steelmaking inclusions are increased, a number of surface defects such as scabs may occur due to an increase in steelmaking inclusions, a nozzle blocking phenomenon occurs in a continuous casting process. For this reason, the Ti content is controlled to be 0.5% or less and more preferably 0.35% or less.

The content of Cu is more than 0 and 2.0% or less.

Cu is an austenite phase stabilizing element, and is added to secure a certain level of austenite phase fraction at the hot-rolled reheating temperature related to Formula (1), which will be described later. When added in a certain amount, it serves to improve corrosion resistance, but excessive addition decreases toughness due to precipitation hardening, so it is preferable to limit it to 2.0% or less in consideration of the content relationship between Mn and Ni.

The content of Al is 0.1% or less.

Al is useful as a deoxidizing element and its effect can be expressed at 0.005% or more. However, the excessive addition causes the lowering of ductility and toughness at room temperature, so the upper limit is set to 0.1% and need not be contained.

In the present disclosure, the thickness of the hot-rolled steel sheet to improve the low-temperature impact toughness is 6.0 to 25.0 mm. As described above, in the hot-rolled thick plate, there is a brittle problem due to the lack of rolling reduction, and the thickness of the hot-rolled steel sheet according to the present disclosure to solve this problem is 6.0 mm or more. However, the upper limit may be 25.0 mm in consideration of the thickness of the rough-rolled bar. Preferably, it may be 12.0 mm or less so as to be suitable for manufacturing use.

In the hot-rolled steel sheet with excellent low-temperature impact toughness according to an embodiment of the present disclosure, the value of Formula (1) below satisfies the range of 200 to 1,150.

$$1001.5*C+1150.6*Mn+2000*Ni+395.6*Cu-0.7*Si-1.0*Ti-45*Cr-1.0*P-1.0*Al+1020.5*N \quad (1)$$

Here, C, Mn, Ni, Cu, Si, Ti, Cr, P, Al and N mean the content (% by weight) of each element.

To secure the austenite phase fraction at the reheating temperature for hot rolling, it is preferable to control the austenite index (γ index) of Formula (1) to 200 or more within the range of the alloy composition described above. By securing an austenite index of 200 or more in the reheating temperature range around 1,200° C., austenite phase transformation and recrystallization are induced, and a final ferrite phase of a fine grain can be obtained through this.

However, if the austenite phase fraction at the reheating temperature is too high, the microstructure of the final hot-rolled steel sheet will undergo some martensitic transformation rather than a single ferrite phase. The microstructure containing some of the martensite phase has excellent impact toughness at room temperature, but has very poor impact toughness at low temperatures. The austenite phase fraction at the reheating temperature is very important and can be controlled through the austenite index (γ index) of Formula (1) presented in the present disclosure. Therefore, the austenite index (γ index) of Formula (1) is limited to 1,150 or less, more preferably 700 or less.

The final ferrite microstructure can be divided into complete grains recrystallized and sub-grains according to misorientation between grains.

Sub-grains are quasi-grain formed to achieve thermodynamic equilibrium and reduce unstable energy that increases as dislocations are generated, and are also called contours. Non-uniform deformation and movement of atoms to a non-equilibrium position are generated by hot rolling, resulting in dislocation and stacking defects, and the presence of such defects increases the free energy of the system, so it recovers spontaneously without defects. Among the defects, edge dislocations can cause dislocation sliding even at relatively low temperatures. A low angle boundary with a small angle of the arranged mismatch boundaries can be formed, and a region surrounded by the low angle boundary is called a sub-grain.

For example, a grain having a misorientation between grains of 15 to 180° may be referred to as a complete grain recrystallized, and a grain of 2 to 15° may be referred to as a sub-grain. In the present disclosure, among sub-grains, grains with misorientation between grains of 2 to 5° and grains of 5 to 15° were further classified.

If the alloy composition of the present disclosure and the range of Formula (1) are satisfied, the hot-rolled steel sheet can secure a fine ferrite phase grain through austenite phase transformation and recrystallization.

The average grain size of the hot-rolled steel sheet according to an embodiment of the present disclosure in which the misorientation between grains of the microstructure of the cross-section perpendicular to the rolling direction is 5° or more satisfies 50 μm or less.

Specifically, the average size of complete grains with a misorientation between grains of 15 to 180° may be 70 μm or less, and grains of 5 to 180° misorientation including sub-grains with a misorientation between grains of 5 to 15° may have an average size of 50 μm or less. In addition, grains of 2 to 180° misorientation including sub-grains having a misorientation between grains of 2 to 5° may have an average size of 30 μm or less.

Sub-grain is a fine grain, so it affects the impact toughness, but a complete grain of recrystallized misorientation of 15 to 180° has a greater impact on the impact toughness. This is predicted because the impact energy is absorbed by the grain boundary, and the grain boundary of the complete grain can absorb more impact energy than the sub-grain.

Accordingly, the hot-rolled steel sheet with excellent low-temperature impact toughness of the present disclosure may indicate −20° C. Charpy impact energy of 100 J/cm$^2$ or more.

Next, a manufacturing method of a hot-rolled steel sheet with excellent low-temperature impact toughness according to an embodiment of the present disclosure is described.

A manufacturing method of a hot-rolled steel sheet with excellent low-temperature impact toughness according to an embodiment of the present disclosure includes: heating the slab containing in percent (%) by weight of the entire composition, C: more than 0 and 0.03% or less, Si: 0.1 to 1.0%, Mn: more than 0 and 2.0% or less, P: 0.04% or less, Cr: 1.0 to 10%, Ni: more than 0 and 1.5% or less, Ti: 0.01 to 0.5%, Cu: more than 0 and 2.0% or less, N: more than 0 and 0.03% or less, Al: 0.1% or less, the remainder of iron (Fe) and other inevitable impurities, at 1,220° C. or less; rough rolling the heated slab; finishing rolling the rough rolled bar; and winding a hot-rolled steel sheet.

The reason for limiting the numerical value of the alloying element content and the description of the thickness of the hot-rolled steel sheet are as described above.

In addition, as for the alloy composition of the slab, the value of Formula (1) below may satisfy the range of 200 to 1,150, and more preferably, may satisfy the range of 200 to 700, as described above.

In addition, the alloy composition of the slab may satisfy the range of 200 to 1,150 in the value of Formula (1) below, as described above, and more preferably, satisfy the range of 200 to 700.

$$1001.5*C+1150.6*Mn+2000*Ni+395.6*Cu-0.7*Si-1.0*Ti-45*Cr-1.0*P-1.0*Al+1020.5*N \quad (1)$$

After heating the slab containing the alloy element of the above composition to 1,220° C. or less prior to hot rolling, the heated slab may be roughly rolled. The slab heating temperature is preferably 1,220° C. or less for dislocation generation through low temperature hot rolling, and when the slab temperature is too low, rough rolling is impossible, so the lower limit of the heating temperature may be 1,150° C. or higher.

At this time, it is possible to control the reduction ratio in the final rolling mill of rough rolling to 27% or more. In general, when the thickness of the hot-rolled steel sheet is thick, the reduction ratio is lowered, so that the amount of dislocation is reduced as the stress applied to the material is low. Therefore, as the thickness of the hot rolled steel sheet becomes thicker, the heating furnace temperature before hot rolling is made as low as possible, and when hot rolling, the load distribution of the rough rolling is moved to the rear end to perform a strong reduction at the rear end having a lower temperature than the front end. In this way, by strongly reducing so that the reduction ratio in the last rolling mill of rough rolling becomes 27% or more, it is possible to smoothly generate dislocations of the hot-rolled steel sheet.

The temperature of the rough rolled bar manufactured through the rough rolling process may be 1,020 to 970° C., and after finishing rolling to a thickness of 6.0 to 25.0 mm, it may be wound. The end temperature of the finishing rolling may be 960° C. or less. More preferably, the finishing rolling end temperature may be 920° C. or less.

The coiling temperature may be 850° C. or less. If the coiling temperature is higher than 850° C., it is preferable to wind it at 850° C. or less because it may correspond to the austenite phase region and a martensite phase may be generated during the cooling process.

For the wound hot-rolled steel sheet, hot-rolled annealing can be performed as required. In this case, the hot rolling annealing temperature may be 850° C. or less.

A microstructure of the cross-section perpendicular to the rolling direction of the wound hot-rolled steel sheet may have an average grain size of 50 μm or less in which misorientation between grains is 5° or more.

Hereinafter, it will be described in more detail through a preferred embodiment of the present disclosure.

Example

After heating the slab of the composition shown in Table 1 below to 1,200° C., the reduction ratio in the last rolling mill of the rough rolling was set to 30%, and the hot rolling was performed to a thickness of 10.0 mm so that the temperature of the rough rolled bar before the finishing rolling was about 1,000° C., and the temperature at the end of the finishing rolling was 910° C.

TABLE 1

| | Steel grade (wt %) | | | | | | | | | |
|---|---|---|---|---|---|---|---|---|---|---|
| | C | Si | Mn | P | Cr | Ni | Ti | Cu | N | Al |
| 9A | 0.007 | 0.5 | <0.05 | 0.02 | 9.0 | 0.50 | 0.2 | <0.05 | 0.008 | <0.01 |
| 9B | 0.007 | 0.5 | <0.05 | 0.02 | 9.0 | 0.50 | 0.2 | <0.05 | 0.008 | <0.01 |
| 9C | 0.007 | 0.5 | <0.05 | 0.02 | 9.0 | 0.30 | 0.2 | <0.05 | 0.008 | <0.01 |
| 9D | 0.006 | 0.57 | 0.29 | 0.02 | 11.1 | 0.13 | 0.2 | <0.05 | 0.007 | <0.01 |

As shown in Table 2, hot-rolled steel sheets of 9A to 9D steel grade were wound at 750° C., and the austenite index (γ index) value of Formula (1) was shown.

TABLE 2

| | Coiling temperature(° C.) | Formula (1) (γ index) |
|---|---|---|
| 9A | 750 | 1,185 |
| 9B | 750 | 610 |
| 9C | 750 | 210 |
| 9D | 750 | 105 |

1. Microstructure

The microstructure at the point of ¼ thickness of the TD section of the 9A steel with the austenite index (γ index) of Equation (1) controlled to 1,185, the 9B steel with the austenite index (γ index) of Equation (1) controlled to 610, the 9C steel with the austenite index (γ index) of Equation (1) controlled to 210, and the 9D steel with the austenite index (γ index) of Equation (1) controlled to 105 were observed and shown in Table 3 and FIGS. 1 to 8 below.

FIGS. 1 and 2 are cross-sectional microstructure IPF(ND) EBSD photographs and IQ EBSD photographs of the 9A steel. FIGS. 3 and 4 are cross-sectional microstructure IPF(ND) EBSD photographs and IQ EBSD photographs of the 9B steel. FIGS. 5 and 6 are cross-sectional microstructure IPF(ND) EBSD photographs and IQ EBSD photographs of 9C steel. FIGS. 7 and 8 are cross-sectional microstructure IPF(ND) EBSD photographs and IQ EBSD photographs of 9D steel.

TABLE 3

| | Steel grade | grain average size(μm) 15~180° | 5~180° | 2~180° |
|---|---|---|---|---|
| Comparative example 1 | 9A | 19.57 | 14.39 | 13.62 |
| Inventive example 1 | 9B | 48.50 | 10.68 | 8.25 |
| Inventive example 2 | 9C | 23.42 | 16.05 | 15.06 |
| Inventive example 2 | 9D | 150.1 | 98.2 | 76.1 |

As a result of observing the microstructure of the TD cross section of the steel 9A of Comparative Example 1 in which the austenite index (γ index) was controlled to 1,185 at a hot-rolled reheating temperature of 1,200° C., the size of ferrite grains measured by the High Angle Grain Boundary method with misorientation between grains of 15° or more was about 19 μm. In addition, the size of grains measured by the Low Angel Grain Boundary method with misorientation between grains of 5° and 2° or more were found to be 14 μm and 13 μm, respectively. However, the austenite content at the hot-rolled reheating temperature was too high, so that the microstructure of the final hot-rolled material was transformed into a partial martensite phase rather than a single ferrite phase. It is known that the structure composed of martensite phase has excellent impact toughness at room temperature but very poor impact toughness at low temperature.

In the case of the 9B steel and 9C steel corresponding to Inventive Examples 1 and 2, the austenite index (γ index) of Formula (1) is 610 and 210, respectively, and it can be seen that it is lower than that of the 9A steel which is a comparative example. Accordingly, when the misorientation between grains was 5° or more, the grain sizes of the 9B and 9C steels were finely formed to 11 μm and 16 μm, respectively, and were composed of a single phase of ferrite without a martensitic phase. The fine grain of this ferrite single phase is a factor that has a great influence on the improvement of impact toughness.

Referring to FIGS. 1 to 6, it can be seen that the 9A steel EBSD photographs of FIGS. 1 and 2 show no significant difference in grain size compared to the 9B and 9C steel EBSD photographs of FIGS. 3 to 6. Although the average grain size of 9A steel was slightly larger than that of 9B and 9C steels, it was generally less than 50 μm. However, as shown in FIG. 2, some martensitic phases were generated in the ferrite phase, and as a result, it could be estimated that the average grain size was measured to be lower.

In the case of Comparative Example 2 9D steel grade, in which the austenite index (γ index) of Formula (1) is 105 and less than 200, it can be seen that the average size of grains with misorientation between grains of 5° or more was about 98 μm, exceeding 70 μm, and is coarse. In addition, it was confirmed that average grain size with misorientation between grains 15° or more and 2° or more also exceeded twice the present disclosure target.

Referring to FIGS. 7 and 8, it can be seen that the 9D steel is composed of a single phase of ferrite, but the grain size is very coarse.

2. Impact Toughness Evaluation

A Charpy impact test was performed on the 9A to 9D steels at each temperature according to ASTM E 23 standards, and the results are shown in Table 4 below.

TABLE 4

| | | Charpy impact energy(J/cm$^2$) | | | |
|---|---|---|---|---|---|
| temperature | No. | Comparative example 1 (9A) | Inventive example 1 (9B) | Inventive example 2 (9C) | Comparative example 2 (9D) |
| −20° C. | 1 | 10.71 | 325.14 | 348.05 | 6.38 |
| | 2 | 11.18 | 180.84 | 339.18 | 6.75 |
| | 3 | 7.98 | 335.99 | 344.89 | 6.38 |
| 0° C. | 1 | 16.75 | 315.53 | 341.13 | 10.42 |
| | 2 | 35.11 | 322.58 | 339.80 | 8.57 |
| | 3 | 17.69 | 325.14 | 337.90 | 9.68 |
| 20° C. | 1 | 256.18 | 330.25 | 329.61 | 22.97 |
| | 2 | 265.88 | 327.70 | 335.99 | 24.93 |
| | 3 | 345.51 | 324.50 | 338.54 | 24.93 |

FIGS. 9 to 11 are graphs showing Charpy impact energy of 9A to 9D steels at −20° C., 0° C., and 20° C., respectively.

Referring to Table 4 and FIGS. 9 to 11, as a result of measuring the impact absorption energy at each temperature, the 9A steel whose γ index of Formula (1) was controlled to 1,185 showed a high impact absorption energy value of 250 J/cm$^2$ or more at +20° C., but showed a sharp decrease from 0° C., and showed a very low impact absorption energy value of 10 J/cm$^2$ or less at a low temperature of −20° C. It seems that a part of the microstructure is transformed into a martensite phase due to the high γ index in the low-Cr steel material, and the impact toughness at low temperature is rapidly reduced.

However, the impact absorption energy values of the 9B and 9C steel black coils, which are Inventive Examples, have γ indexes controlled to be low to 610 and 210, respectively, so that the impact absorption energy values were measured to be more than 180 J/cm$^2$ at room temperature +20° C., 0° C. and low temperature of −20° C. And, even at low temperatures, it showed excellent impact toughness without deteriorating the impact absorption energy.

On the contrary, 9D steel whose γ index of Formula (1) was controlled to 105 exhibited very poor impact toughness of 25 J/cm$^2$ or less at 0° C. and 20° C. as well as at −20° C.

low temperature. This seems to be due to the fact that the γ index is low, so that fine ferrite phase grains cannot be secured and coarse ferrite phase grains are formed.

In the above description, exemplary embodiments of the present disclosure have been described, but the present disclosure is not limited thereto. Those of ordinary skill in the art will appreciate that various changes and modifications can be made without departing from the concept and scope of the following claims.

INDUSTRIAL APPLICABILITY

Hot-rolled steel sheet with a thickness of 6 mm or more according to the present disclosure exhibits −20° C. Charpy impact energy of 100 J/cm$^2$ or more through grain refinement, so it can be applied as a product for automobile flanges.

The invention claimed is:

1. A hot-rolled steel sheet with excellent low-temperature impact toughness, the hot-rolled steel sheet comprising, in percent (%) by weight of the entire composition, C: more than 0 and 0.03% or less, Si: 0.1 to 1.0%, Mn: more than 0 and 2.0% or less, P: 0.04% or less, Cr: 1.0 to 10%, Ni: more than 0 and 1.5% or less, Ti: 0.01 to 0.5%, Cu: more than 0 and 2.0% or less, N: more than 0 and 0.03% or less, Al: 0.1% or less, the remainder of iron (Fe) and other inevitable impurities, a value of the following Formula (1) satisfies 200 to 1,150, and a microstructure of the cross-section perpendicular to the rolling direction has an average grain size of 50 μm or less for grains having a misorientation between grains is 5° or more, wherein the hot-rolled steel sheet has a thickness of 6.0 to 25.0 mm and −20° C. Charpy impact energy of 180 J/cm$^2$ or more, $$1001.5*C+1150.6*Mn+2000*Ni+395.6*Cu-0.7*Si-1.0*Ti-45*Cr-1.0*P-1.0*Al+1020.5*N, \quad (1)$$

wherein C, Mn, Ni, Cu, Si, Ti, Cr, P, Al and N mean the content (% by weight) of each element.

2. The hot-rolled steel sheet according to claim 1, wherein the value of Formula (1) satisfies 200 to 700.

3. The hot-rolled steel sheet according to claim 1, wherein the hot-rolled steel sheet satisfies the following Formula (2):

$$Ti/(C+N) \geq 10.0 \quad (2).$$

4. The hot-rolled steel sheet according to claim 1, wherein the microstructure has an average grain size of 70 μm or less for grains having a misorientation between grains is 15 to 180°.

5. The hot-rolled steel sheet according to claim 1, wherein the microstructure has an average grain size of 50 μm or less for grains having a misorientation between grains is 5 to 180°.

6. The hot-rolled steel sheet according to claim 1, wherein the microstructure has an average grain size of 30 μm or less for grains having a misorientation between grains is 2 to 180°.

* * * * *